US009308613B2

(12) United States Patent
Eriksson

(10) Patent No.: US 9,308,613 B2
(45) Date of Patent: Apr. 12, 2016

(54) METHOD FOR AUTOMATIC SHARPENING OF A BLADE

(71) Applicant: Eriksson Teknik AB, Njurunda (SE)

(72) Inventor: Magnus Eriksson, Njurunda (SE)

(73) Assignee: Eriksson Teknik AB, Njurunda (SE)

( * ) Notice: Subject to any disclaimer, the term of this patent is extended or adjusted under 35 U.S.C. 154(b) by 0 days.

(21) Appl. No.: 14/533,308

(22) Filed: Nov. 5, 2014

(65) Prior Publication Data

US 2015/0140901 A1 May 21, 2015

Related U.S. Application Data

(63) Continuation-in-part of application No. 14/525,093, filed on Oct. 27, 2014.

(60) Provisional application No. 61/905,981, filed on Nov. 19, 2013.

(51) Int. Cl.

| | |
|---|---|
| ***B24B 49/10*** | (2006.01) |
| ***B24B 9/04*** | (2006.01) |
| ***B24B 3/00*** | (2006.01) |
| ***B24B 41/00*** | (2006.01) |

(52) U.S. Cl.

CPC . *B24B 3/003* (2013.01); *B24B 9/04* (2013.01); *B24B 41/005* (2013.01)

(58) Field of Classification Search

CPC ..... B24B 9/04; B24B 3/003; B24B 3/00; B24B 49/10

USPC ..... 451/45, 28, 383, 150, 152, 5, 8, 9, 10, 451/11

See application file for complete search history.

(56) References Cited

U.S. PATENT DOCUMENTS

| | | | | |
|---|---|---|---|---|
| 3,735,533 | A * | 5/1973 | Salberg | B24B 3/003 451/152 |
| 4,229,909 | A * | 10/1980 | Dial, Sr. | B24B 3/34 451/276 |
| 4,722,152 | A * | 2/1988 | Ek | B24B 3/003 451/152 |
| 4,817,339 | A * | 4/1989 | Weidmo | B24B 3/003 451/28 |
| 7,220,161 | B2 * | 5/2007 | Eriksson | B24B 3/003 451/120 |

* cited by examiner

*Primary Examiner* — Robert Rose

(74) *Attorney, Agent, or Firm* — Fasth Law Offices; Rolf Fasth

(57) ABSTRACT

The method is for sharpening a blade. An automatic sharpening apparatus is provided that has a holder. A blade is placed into the holder. A grinding-wheel driving motor, in operative engagement with a wheel on a spindle, rotates a grinding wheel. A grinding assembly motor moves the grinding wheel in an x-direction towards the blade. A linear motor moves the grinding wheel from a first position to a second position in a z-direction without moving the grinding-wheel driving motor. The rotating grinding wheel engages the blade. The grinding wheel sharpens the blade.

5 Claims, 10 Drawing Sheets

METHOD FOR AUTOMATIC SHARPENING OF A BLADE

PRIOR APPLICATION

This US patent application claims priority from U.S. Utility patent application Ser. No. 14/525,093, filed 27 Oct. 2014 that claims priority from U.S. Provisional Patent Application No. 61/905,981 filed 19 Nov. 2013.

TECHNICAL FIELD

The invention relates to a method for automatic sharpening of a blade such as a skate blade.

BACKGROUND AND SUMMARY OF THE INVENTION

Sharpening apparatuses for sharpening blades such as skate blades have been available for decades. However, the prior art sharpening apparatuses are manual and require extensive skills and experience of the person doing the sharpening. This results in varying sharpening results and makes it more difficult for users of skate blades to obtain properly sharpened skate blades. There is a need for an effective sharpening method and apparatus that is easy to use while providing consistent and high-quality sharpening of skate blades.

The method of the present invention provides a solution to the above-outlined problems. More particularly, the method of the present invention is for sharpening a blade. An automatic sharpening apparatus is provided that has a holder. A blade is placed into the holder and clamping mechanism. A grinding-wheel driving-motor, in operative engagement with a wheel on a spindle, rotates a grinding wheel via a belt of a belt transmission system. A grinding-assembly motor moves the grinding wheel in an x-direction towards the blade. A linear-motor moves the grinding wheel from a first position to a second position in a z-direction without moving the grinding-wheel driving-motor. The rotating grinding-wheel engages the blade. The grinding-wheel sharpens the blade.

The method further comprises the step of providing a magnetic spring in operative engagement with the linear motor. The spring provides a counter-weight to a weight of the grinding wheel, a transmission assembly a tool exchange assembly and other components moved or lifted by the linear motor in the z-direction.

The method further comprises the step of moving rollers and a grinding-wheel driving wheel to maintain a constant belt tension of the belt as the set of grinding wheels is moved in the z-direction.

The method further comprises the step of a precision member moving the grinding wheel in a y-direction relative to the grinding-wheel driving-motor and the blade.

The method further comprises the step of the grinding assembly motor moving the grinding wheel in the x-direction simultaneously as the linear motor moves the grinding wheel in the z-direction.

The method further comprises the step of maintaining the grinding-wheel driving-motor in a stationary position while moving the grinding wheel in the x-direction, the y-direction and the z-direction.

DETAILED DESCRIPTION

Figure 1:
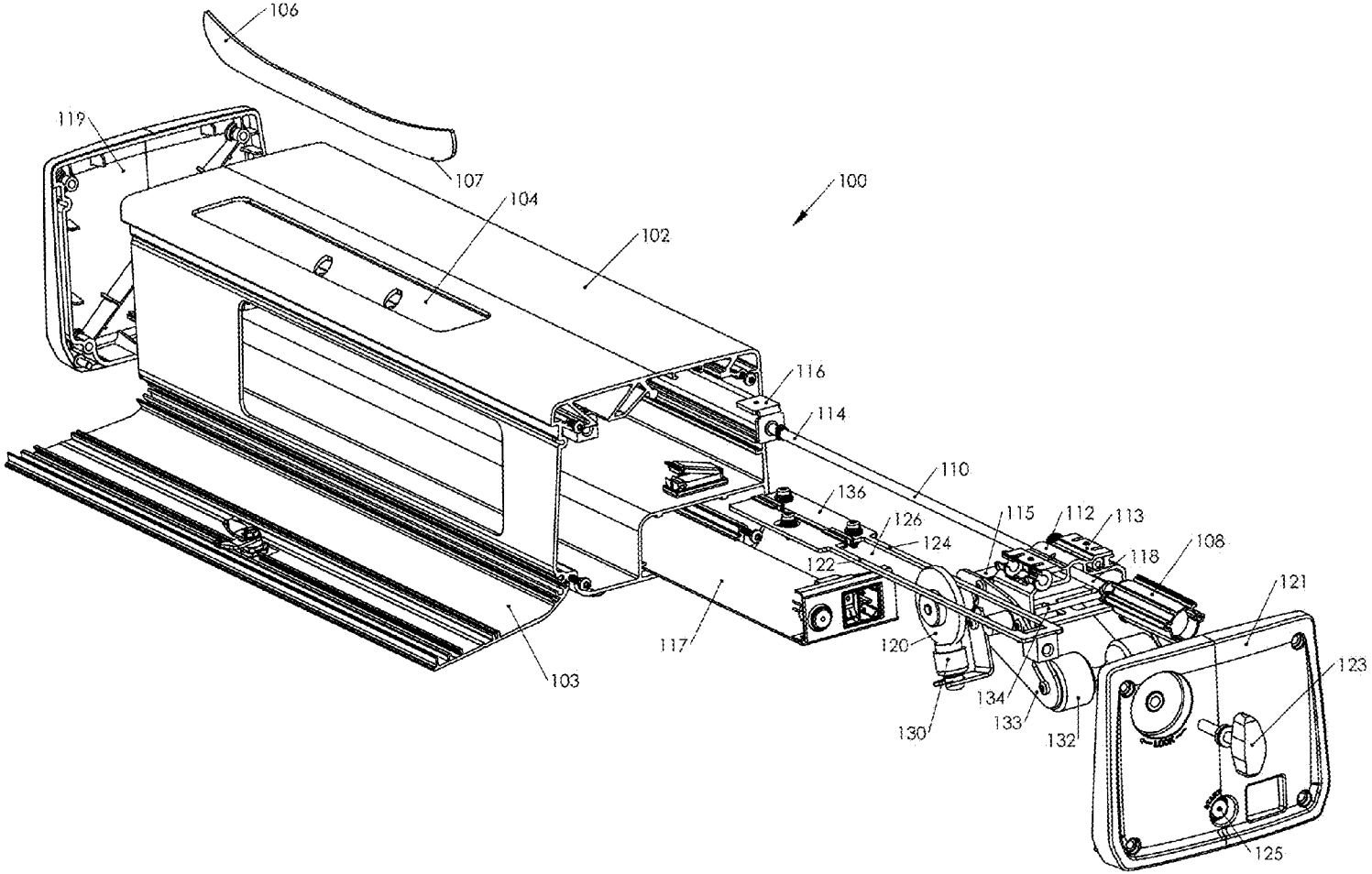
FIG. 1 is a perspective exploded view of the blade sharpening apparatus of the present invention.
Figure 4A:
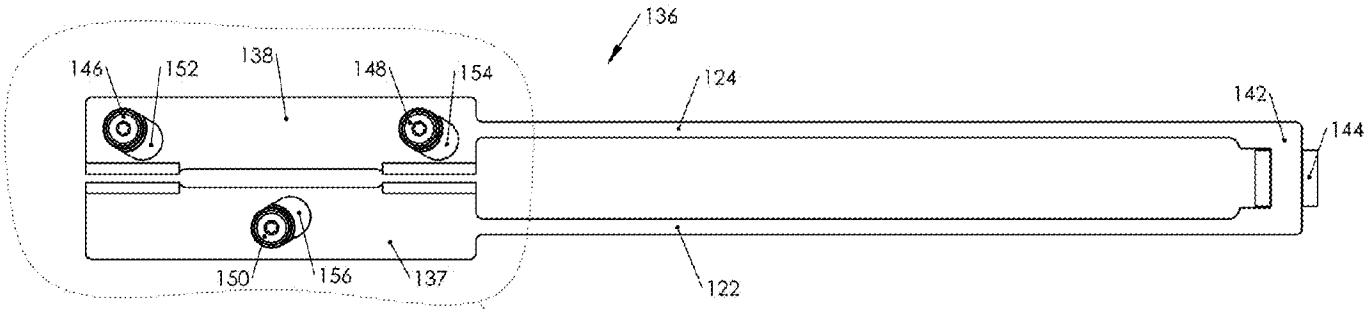
FIG. 4A is a top view of the clamp of FIG. 3A in a closed position.
Figure 4B:
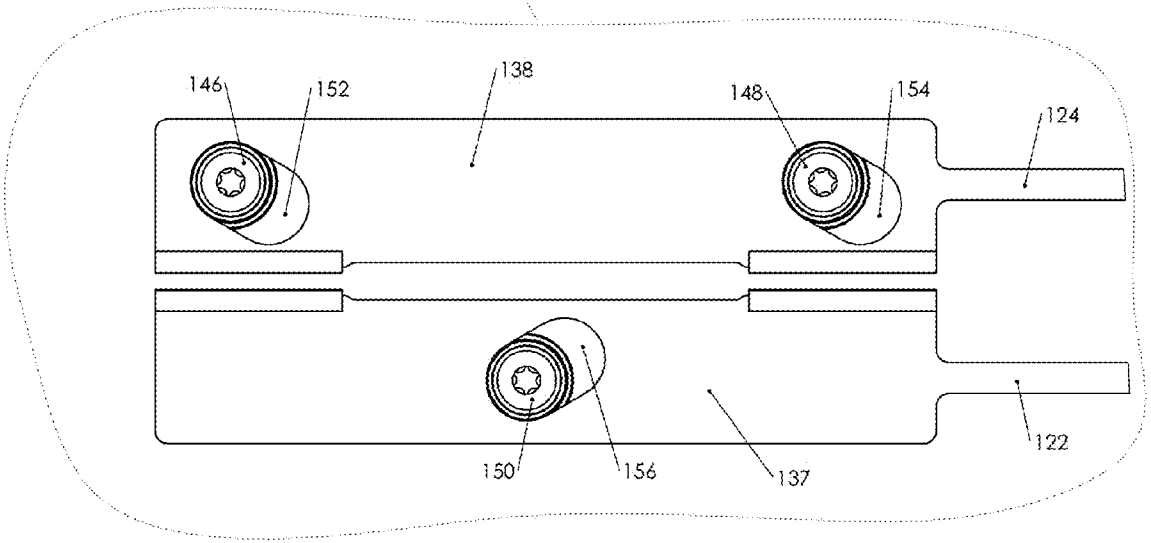
FIG. 4B is a detailed view of the self-centered clamp shown in FIG. 4A.
Figure 5:
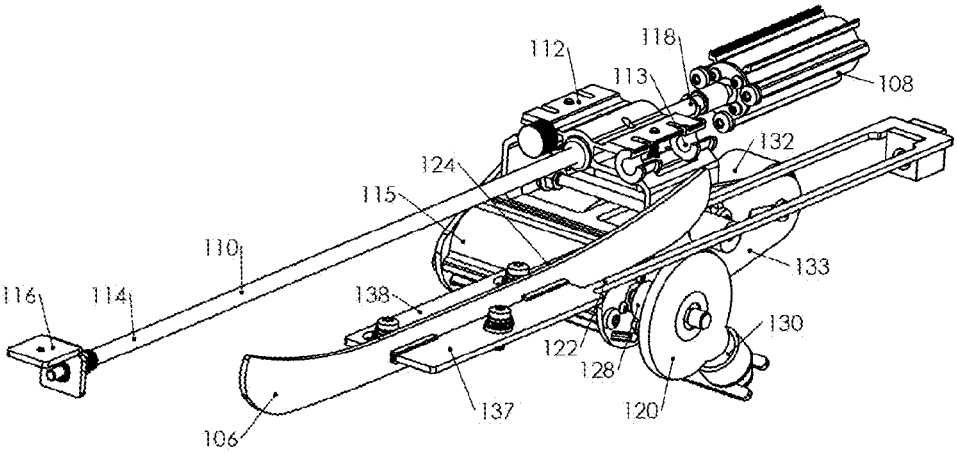
FIG. 5 is a perspective view of a portion of the apparatus having a skate blade clamped therein.

FIG. 1 is a perspective exploded view of the blade sharpening apparatus 100 of the present invention and FIG. 5 is an assembled perspective view of the apparatus 100. One important feature of the present invention is that the sharpening of a blade, such as a skate blade 106, is done automatically by simply placing the blade inside an elongate opening 104 of a rectangular-shaped housing 102 and then turning on the apparatus to start the grinding/sharpening process of the blade 106. More particularly, a motor 108 is operatively attached to a lead screw 110 for moving a grinding mechanism 112 back and forth inside the housing 102. The lead screw 110 is threaded and has one end 114 attached to a fastener 116 that is attached to the wall of the housing 102 and the opposite end 118 attached to the motor 108. The grinding mechanism 112 moves smoothly in a forward or backward direction inside the housing 102 when the motor 108 rotates the lead screw 110. The grinding mechanism 112 has a movable grinding wheel 120 that is placed inside a groove 126 defined between elongate bars 122, 124 so that the grinding wheel 120 can move back and forth inside the groove 126. The grinding wheel 120 is also axially adjustable along the spindle driving the grinding wheel 120 by using a double-thread mechanism so that the wheel 120 is in the correct position inside the groove 126. This adjustment mechanism is shown in detail in FIG. 6 and described below. The bars 122, 124 terminate in a clamping mechanism 136 that is described in detail in FIGS. 3A-3B and 4A-4B below.

Figure 2A:
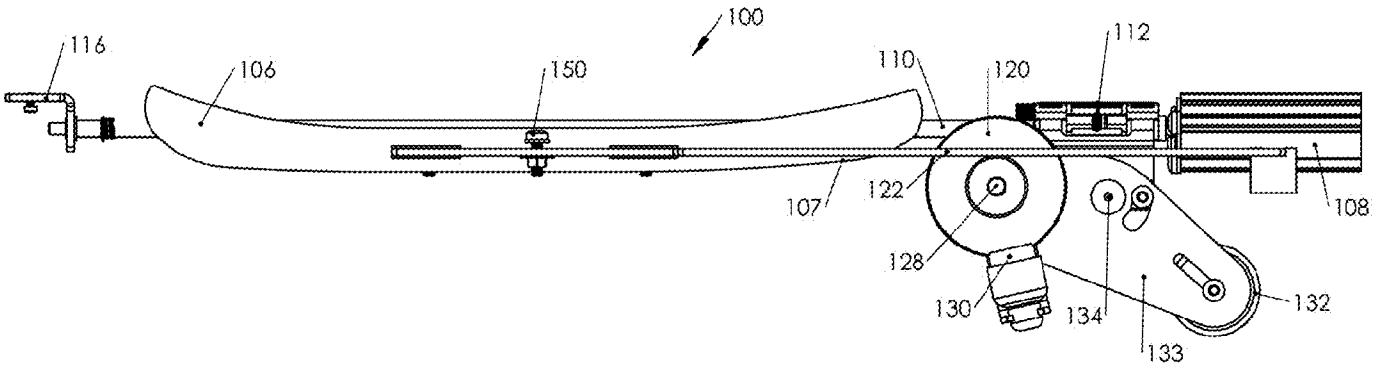
FIG. 2A is a side view of a portion of the blade sharpening apparatus showing a grinding wheel prior to engagement.
Figure 2B:
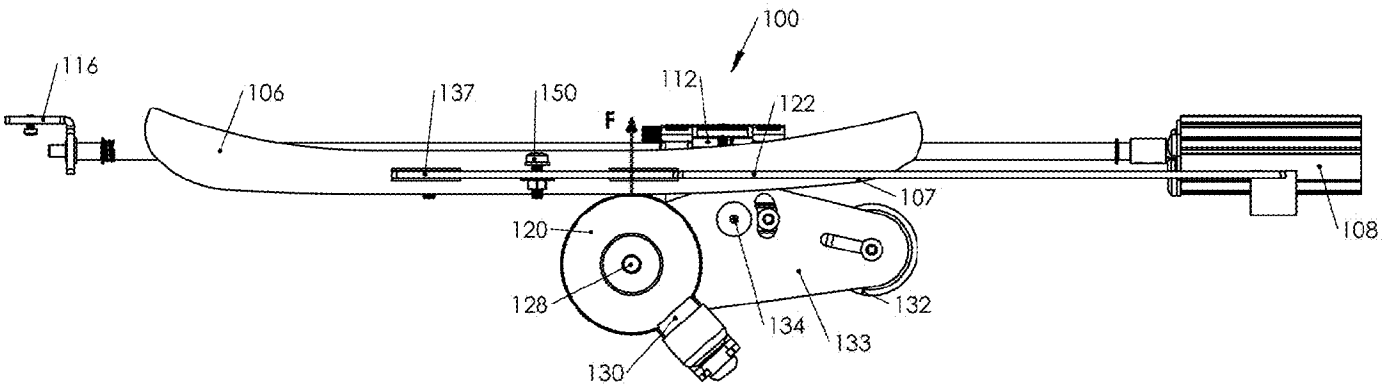
FIG. 2B is a side view of a portion of the blade sharpening apparatus showing a grinding wheel during engagement.

As best seen in FIGS. 2A-2B, the grinding wheel 120 is mounted on a rotatable spindle 128 that, in turn, is connected to a motor-unit 115 to drive the grinding wheel 120. FIG. 2A shows the grinding wheel 120 prior to engaging the skate blade 106 and FIG. 2B shows the grinding wheel 120 during operation i.e. when sharpening the bottom of the skate blade 106. The grinding wheel 120 may be made of steel with cubic boron nitride (CBN) or any other suitable material. Preferably, the grinding wheel has a pre-made profile such as a hollow radius or any other suitable profile. A sponge 130 may be placed close to the grinding wheel 120 for applying a cooling liquid to the grinding wheel 120 when it is used for grinding the skate blade 106 to sharpen edges of the blade 106. The grinding wheel 120 is in operative engagement, via a support 133, with a counter weight 132 that by gravity counter weighs the weight of the grinding wheel 120 to ensure that a correct grinding wheel pressure is applied against the blade 106 during the entire grinding process and so that the grinding wheel 120 can follow a contour 107 or shape of the blade 106 while applying a constant and correct grinding pressure against the blade 106 during the grinding process. Preferably, the counter weight 132 is mounted with rubber rings to smoothen the start of the grinding process. Both the grinding wheel 120 and the counter weight 132 on the support 133 are balanced about an axle 134 in the grinding mechanism 112. In this way, the grinding wheel 120 can smoothly follow the shape of the blade 106 as the support 133 pivots about axle 134 and the counter-weight 132 provides the counter-weight so that the correct grinding pressure by the grinding wheel 120 is used.

The grinding mechanism 112 has a wagon 113 for driving the grinding wheel 120 with low-friction glide-bushings in operative engagement with the bearing-mounted motor-unit 115. An electronic unit 117 includes the necessary electronic components to operate the apparatus 100 such as power supply and circuit board. The housing 102 has a side wall 103 and short-end walls 119 and 121 of which short-end wall 121 has a knob 123 for tightening the elongate clamp bars 122, 124 about the skate blade 106 inserted therebetween. By turning knob 123, the bars 122, 124 either moves away or towards the short-end wall 121. When the bars 122, 124 move towards the wall 121 a clamping pressure is applied about the skate blade 106. Of course, the apparatus 100 could also be constructed so that the clamping pressure is applied when the bars move away from wall 121. The wall 121 may have a switch 125 for turning on and off the apparatus 100. By turning on the switch 125, the motors 108 and 115 are turned on so that the grinding wheel 120 starts rotating to sharpen the blade 106 and the entire grinding mechanism 112 starts moving towards the blade 106. It is also possible that the apparatus may be activated by simply lowering the blade 106 into the housing 102 until a sensor starts the apparatus without the use of a manual switch 125.

Figures 3A, 3B:
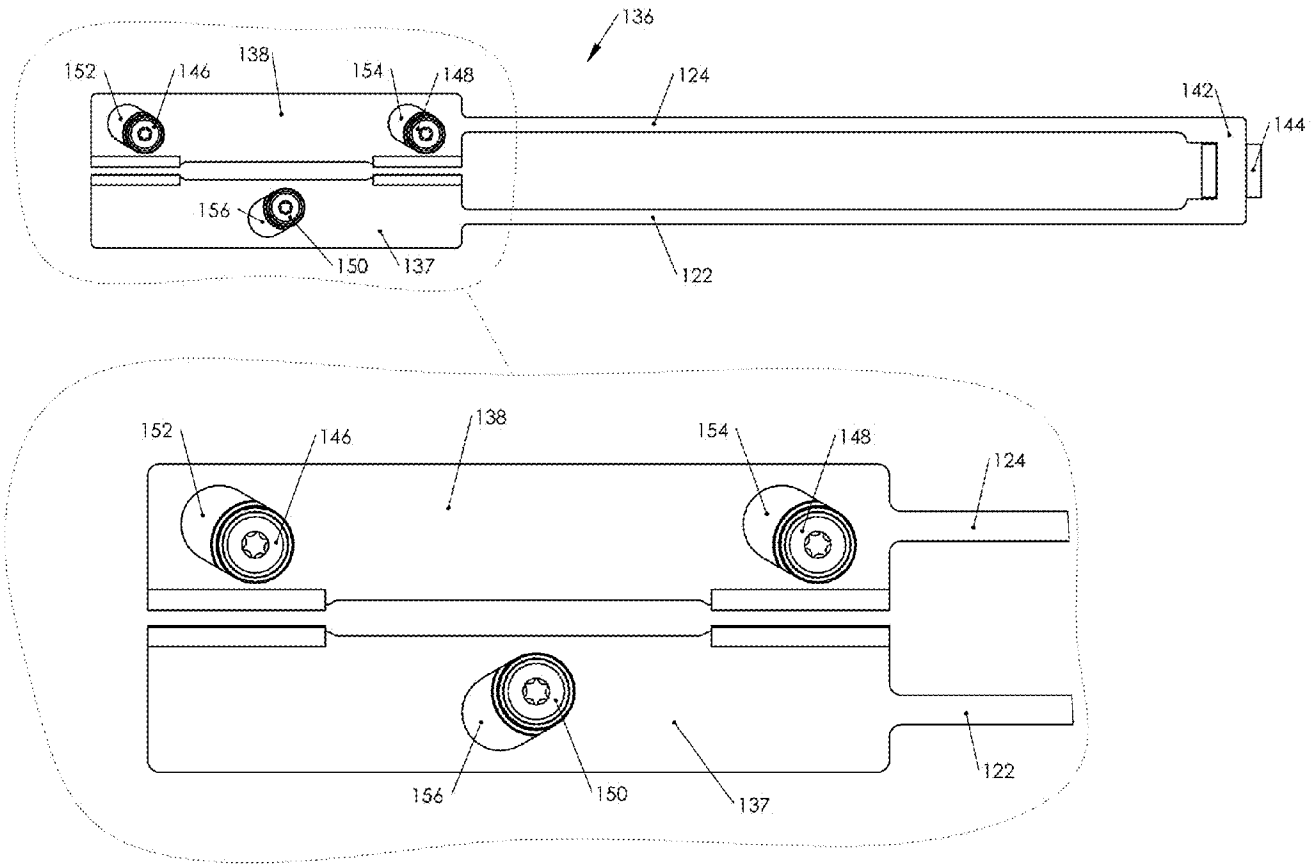
FIG. 3A is a schematic top view showing a self-centered clamp in an opened position.
FIG. 3B is a detailed view of the self-centered clamp shown in FIG. 3A.

FIG. 3A is a top view of a clamping mechanism 136 of the present invention. The outer ends 140, 141 of bars 122, 124 have clamp holders 137, 138, respectively. An opposite end 142 has a threaded portion 144 for moving the clamping mechanism relative to the adjustment screws 146, 148 and 150 by turning knob 123 (shown in FIG. 1) because the knob 123 is in operative engagement with the threaded portion 144. The adjustment screws 146 and 148 are placed inside angled elongate openings 152, 154, respectively, of clamp holder 138 and the adjustment protrusions 150 is place inside an angled elongate opening 156 of clamp holder 137. An important feature is that the openings 152, 154 and 156 are at an angle, other than a right angle, relative to the movement of the clamping mechanism 136. By pulling the clamping mechanism 136 relative to the adjustment protrusions 146, 148 and 150, the protrusions slide relative to the elongate openings 152, 154 and 156, respectively, to move the clamping mechanism 136 between an opened position (see FIGS. 3A-3B) and a closed position (see FIGS. 4A-4B). When the clamping mechanism 136 is in the opened position a gap 158 is wide enough to receive the blade 106 and when the clamping mechanism is in the closed position, the gap 158 is tight to firmly hold the blade 106 during the grinding process. Because the clamping mechanism 136 is self-centered, the apparatus 100 can receive a wide range of blade widths.

Figure 6:
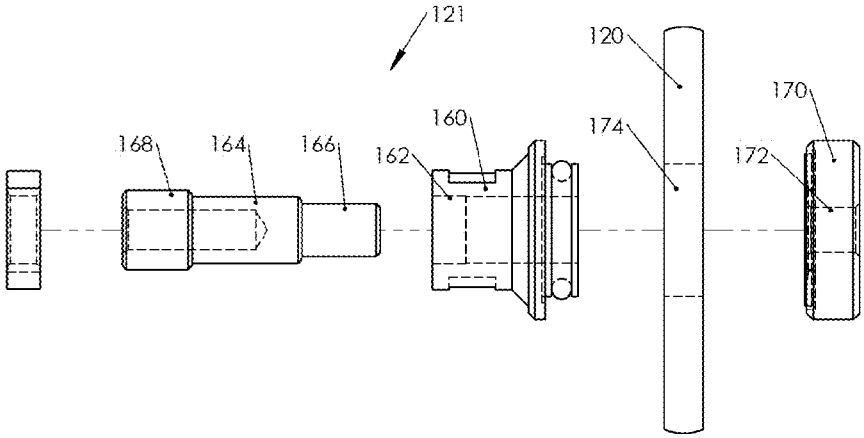
FIG. 6 is an exploded side view of the grinding wheel and the double-threaded fastening mechanism.

FIG. 6 is an exploded side view of the adjustable grinding wheel assembly 121 that has the grinding wheel 120 and an intermediate coupling 160 inserted into a central opening 174. The coupling 160 has a threaded opening 162 for receiving a threaded fastener 164 that has a first threaded outer portion 166 and a second threaded inner portion 168. When assembled the outer portion 166 engaged a threaded opening 172 of a wheel holder 170 that is placed on the other side of the grinding wheel and the inner portion 168 engaged the threaded opening 162. By turning the coupling 160 relative to the fastener 164 the sideways position of the grinding wheel 120 inside the groove 126 may easily be adjusted so that it is properly aligned with the blade 106.

Figure 7A:
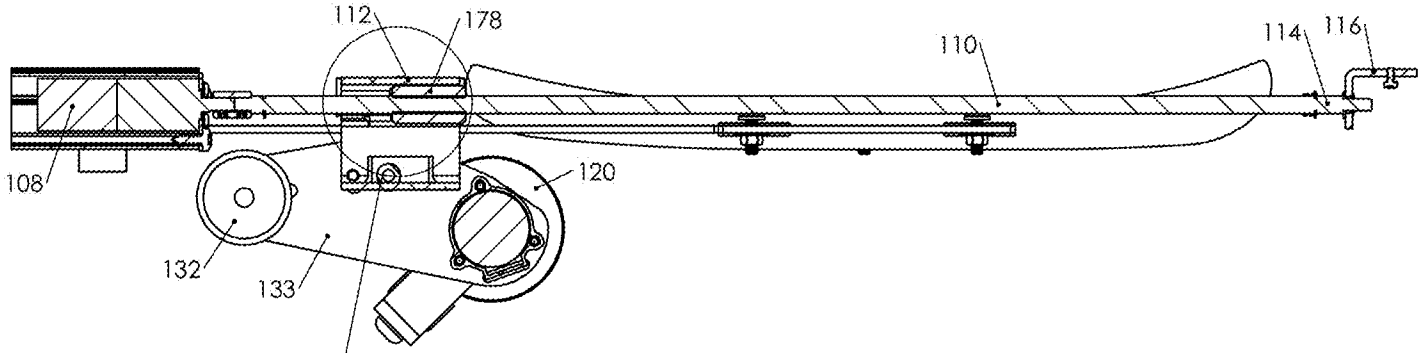
FIGS. 7A and 7B are side views of a portion of the apparatus showing a detail of the treaded lead screw.
Figure 7B:
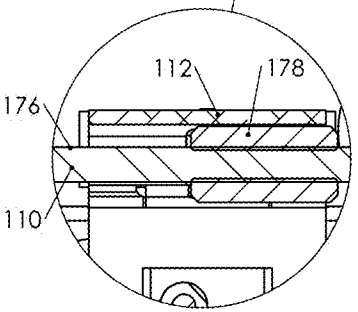

FIG. 7 is a side view of the threaded lead screw 110 engaging the grinding assembly 112. When motor 108 rotates the screw 110, the threaded outside 176 of the screw 110 engages a threaded portion 178 of the assembly 112 so that the entire assembly 112 moves relative to the screw 110 and relative to the blade 106 (not shown in FIG. 7) and so that the grinding wheel 120 moves along the blade 106 during the grinding or sharpening process.

In operation, the user simply places the blade 106 inside opening 104 and turns on the apparatus 100 by activating switch 125 so that the automatic self-centered clamping mechanism 136 can clamp the blade 106 and hold it firmly in place. Because the clamping mechanism 136 is automatic and self-centered relative to the position of the grinding wheel 120, it automatically adjusts itself to the width of blade 106. By turning on the apparatus 100, the grinding wheel 120 starts rotating and the grinding mechanism 112 starts moving towards the blade 106. The counter-weight 132 ensures that correct grinding pressure on the underside of the blade 106 is applied by the grinding wheel 120. Because both the counter-weight 132 and the grinding wheel 120 are rotatable or pivoting about axle 134, the grinding wheel 120 can smoothly follow contours or shape of the blade 106 without changing the grinding pressure applied thereon as the lead screw 110 feeds the entire grinding mechanism 112 along the blade 106.

Figure 8:
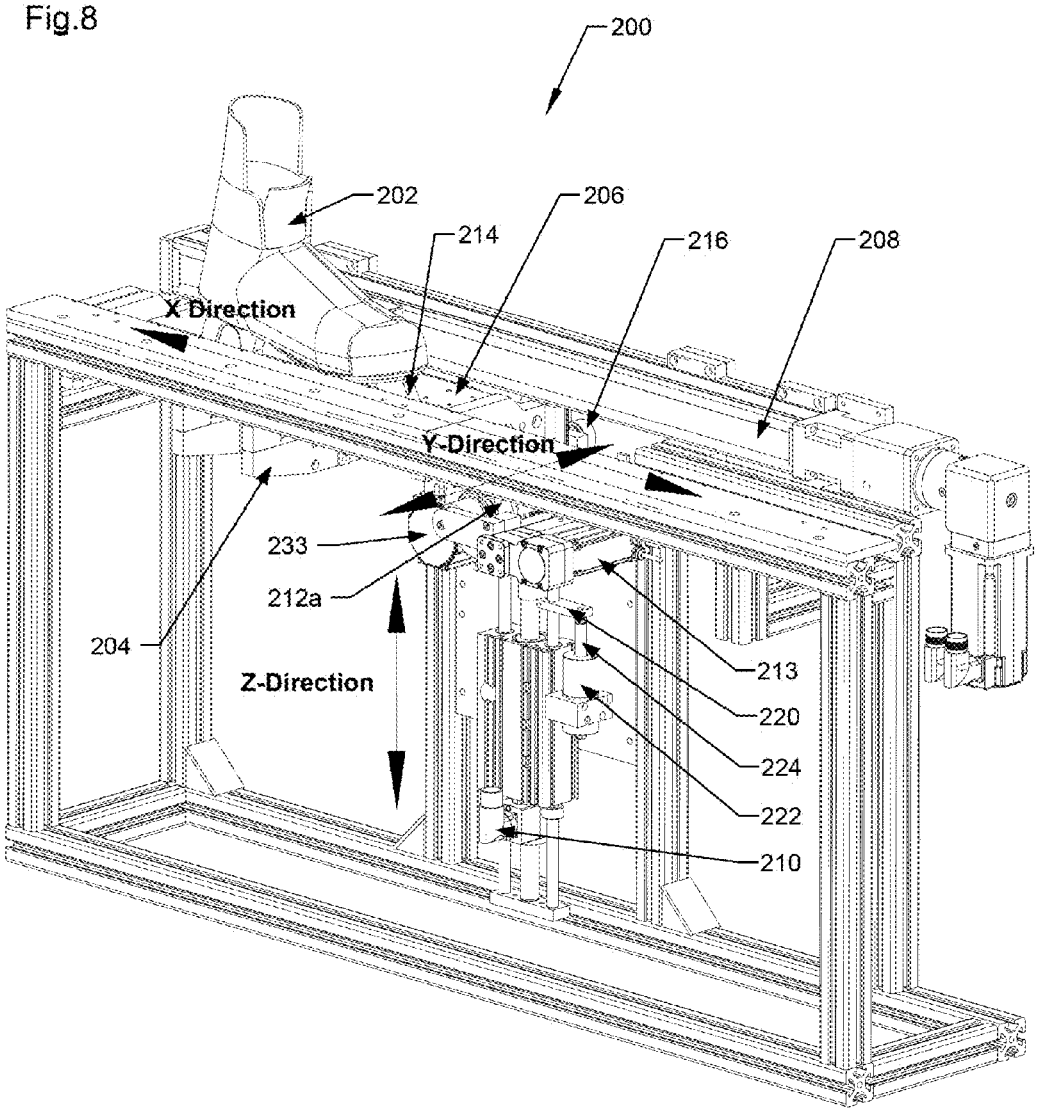
FIG. 8 is a perspective view of the blade sharpening apparatus of the present invention.

FIG. 8 is a perspective view of the blade sharpening apparatus 200 of the present invention. A skate 202 is attached to a holder 204 that in turn is attached to a self-centered clamping member 206 that is movable back and forth in the x-direction i.e. along the apparatus 200. An electric programmable motor 208 transports the skate 202, the holder 204 and clamping member 206 back and forth in the x-direction. An electric programmable linear motor 210 moves grinding wheels 212*a*, 212*b* and 212*c* in a z-direction. The exact movement in the z-direction depends on the desired profile of a skating blade 214. Motor 210 together with assembly 213 create a linear movement in the z-direction to exactly control the positions of the grinding wheels 212 in the z-direction while the motor 208 moves the grinding mechanism in the x-direction. The movement in the z-direction is thus carefully matched to the movement of the blade 214 in the x-direction, according to the computer program, to accomplish to the desired curved profile of blade 214. The grinding wheels 212 are preferably made of steel with cubic boron nitride (CBN) or any other suitable material. Preferably, the grinding wheels each have a different pre-made profile such as a hollow radius or any other suitable profile. A transmission assembly 216 enables the grinding wheels 212 to rotate at a desired revolution per minute (rpm) such as between 4,000-6000 rpm. A tool exchange assembly 218 positions the grinding wheels 212 in the correct position in the y-direction. The details of the apparatus 200 are described below.

Figure 9A:
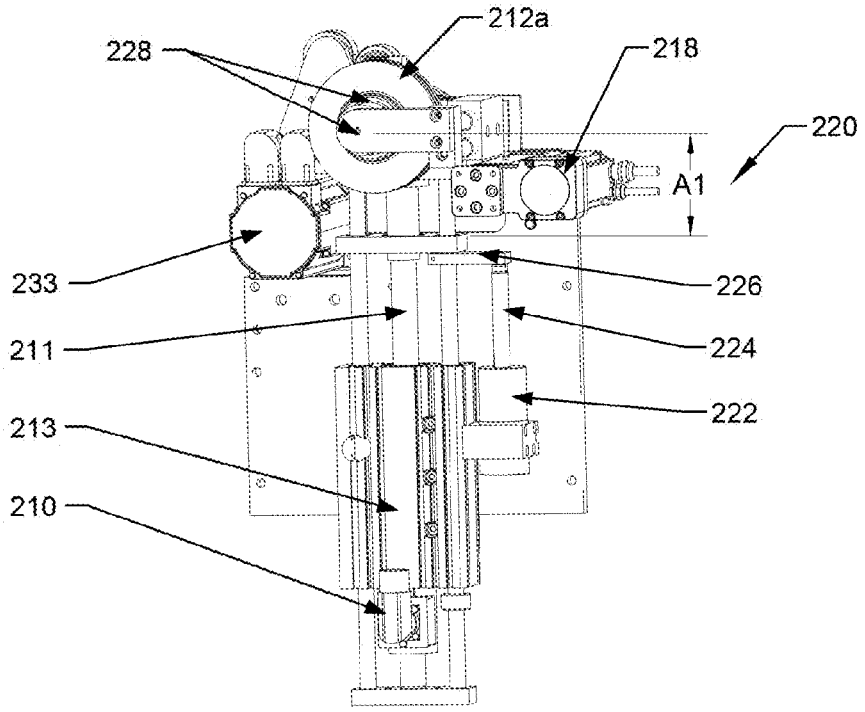
FIG. 9A is a perspective side view of the linear motor assembly when the grinding wheels are in an upper position.
Figure 9B:
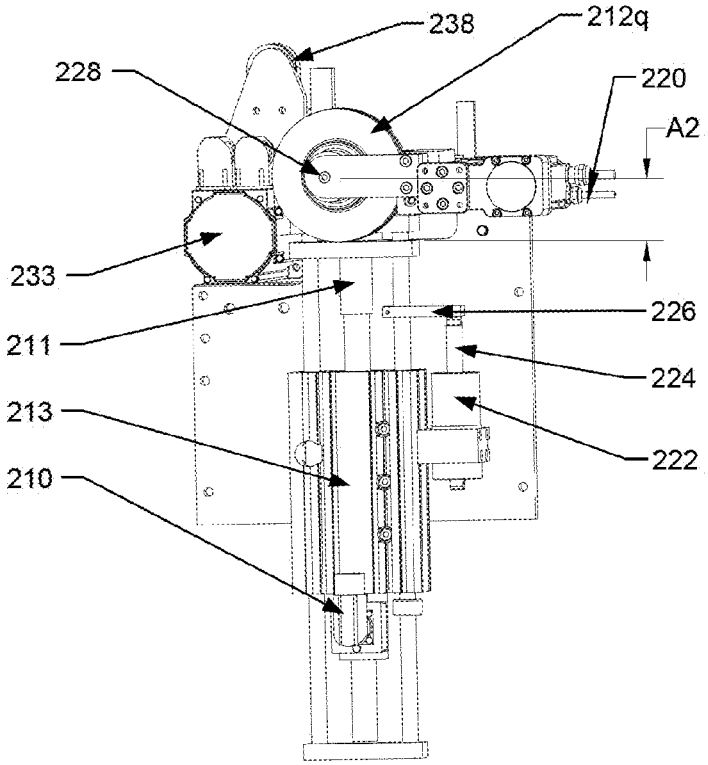
FIG. 9B is a perspective side view of the linear motor assembly when the grinding wheels are in a lower position.

FIGS. 9A-9B are detailed views of an assembly 220 of apparatus 200 wherein motor 210 and assembly 213 linearly move grinding wheel 212*a* (and grinding wheel 212*b*, 212*c*) in the z-direction according to pre-programmed instructions. The rotation of motor 210 is transformed to linear movement inside the linear transformation assembly 213 so that rod 211 moves linearly in the z-direction. This movement is performed with a very high precision while at the same time motor 208 moves the entire grinding mechanism including the grinding wheels 212 in the x-direction. A magnetic spring 222 is in operative engagement with a rod 224 and a link member 226. One important function of spring 222 is that it counter-balances or acts as a counter-weight to the weight of the grinding wheels 212*a*, 212*b*, 212*c*, spindle 228 and the components of the tool-exchanger 218 when these components move in the z-direction. Because spring 222 acts as a counter-weight, the force required by motor 210 to move the components is close to zero and the precision of the movement in z-direction of motor 210 improves. In other words, spring 222 continuously senses and determines the weight of the components to be lifted by motor 210 including the tool exchange assembly 218, transmission assembly 216 and the grinding wheels 212 and provides a spring force in an upward direction that is substantially similar to all the weight that is to be lifted by motor 210 to counter-act the downward force of the weight of the components that are moved in the z-direction by motor 210. In this way, the motor 210 moves the grinding wheels 212 via rod 211 in the z-direction independent of what load has been applied to the spindle 228 and grinding wheels 212 and independent of the weight of all the components of the transmission assembly 216 and tool exchange assembly 218. FIG. 9A shows spindle 228 in an upper position as indicated by distance A1 and FIG. 9B shows spindle 228 in a lower position as indicated by distance A2 that is shorter than distance A1.

Figure 10A:
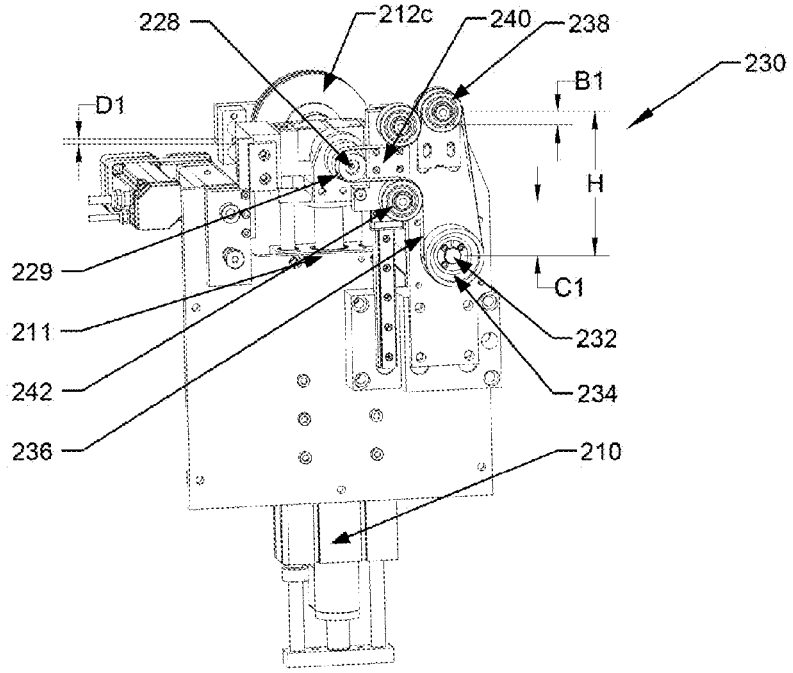
FIG. 10A is a perspective side view of the belt assembly when the grinding wheels are in an upper position.
Figure 10B:
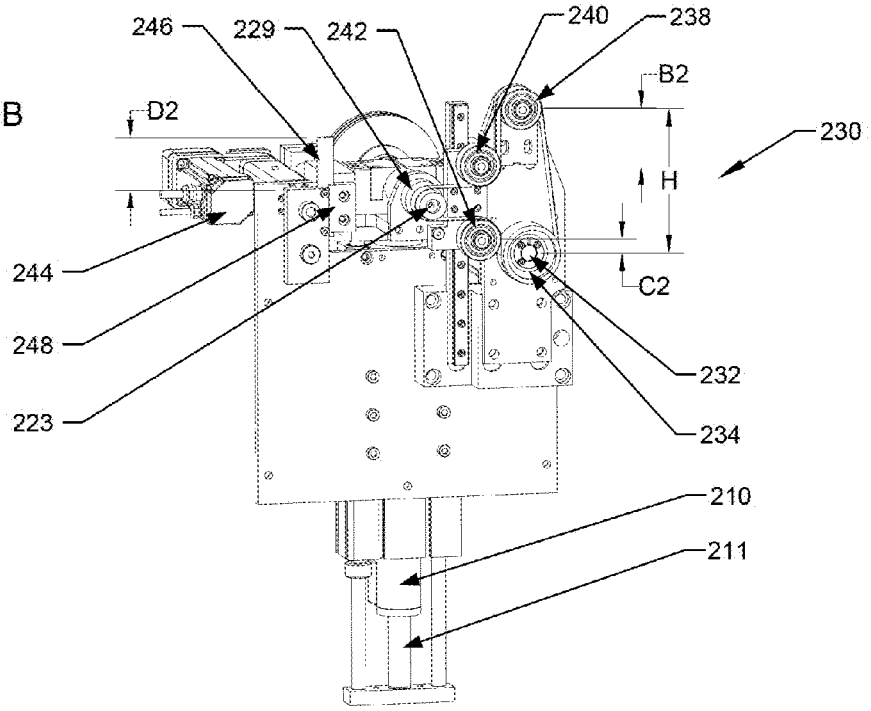
FIG. 10B is a perspective side view of the belt assembly when the grinding wheels are in a lower position.

FIGS. 10A and 10B are detailed views of an assembly 230 of apparatus 200 wherein a motor spindle 232 has driving wheel 234 for driving spindle 228 via a belt 236 of a belt assembly having guiding rollers 238, 240 and 242. By using the belt assembly the gearing may be increased so that a smaller and light-weight single-phase motor 232 can be used compared to the motor required if the belt assembly was not used. One important function is that motor 232 is preferably fixedly attached in the z-direction to the housing or frame of apparatus 200 and is thus not movable in the z-direction by motor 210. This means all cables going into the motor do not have to be continually bent up and down as the assembly is moved up and down in the z-direction. Worn-out and broken cables are a common source for errors. This source of errors has been eliminated in the present invention. Another important function of assembly 230 is to keep the tension of the belt 236 constant even though spindle 228 is moved in the z-direction by motor 210, as explained above regarding FIGS. 2A-2B. In other words, rollers 240, 242 and wheel 229 including spindle 228 may move relative to spindle 232 while maintaining the same tension of belt 236. However, the position of the rollers 240, 242 and spindle 228 relative to one another is preferably fixed. This means motor 210 does not have to move motor spindle 232 and the motor 233 connected thereto in the z-direction which saves on the weight to be moved or lifted by motor 210. FIG. 10A shows spindle 228 (and thus also rollers 240, 242) in an upper position as indicated by distances B1, C1 and H and FIG. 10B shows spindle 228 in a lower position as indicated by distances B2, C2 and H. Distance B1 is longer than distance B2 and distance C1 is shorter than distance C2. It should be noted that distance H is constant so when distance B1 changes relative to distance B2 the same corresponding change occurs between distance C2 and distance C1 i.e. when, for example, distance B1 increases to distance B2 the same reduction occurs between distance C1 that is reduced to distance C2. In this way, the tension of belt 236 is kept constant.

Figure 11A:
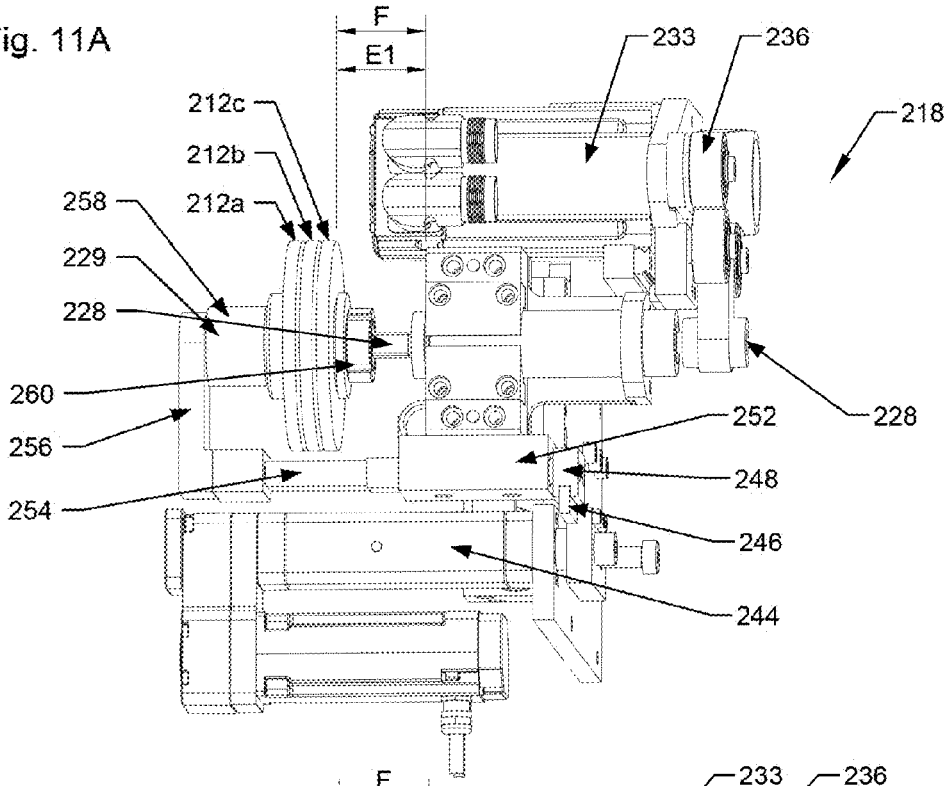
FIG. 11A is a perspective top view of the transmission assembly when the grinding wheels are in an outer position.
Figure 11B:
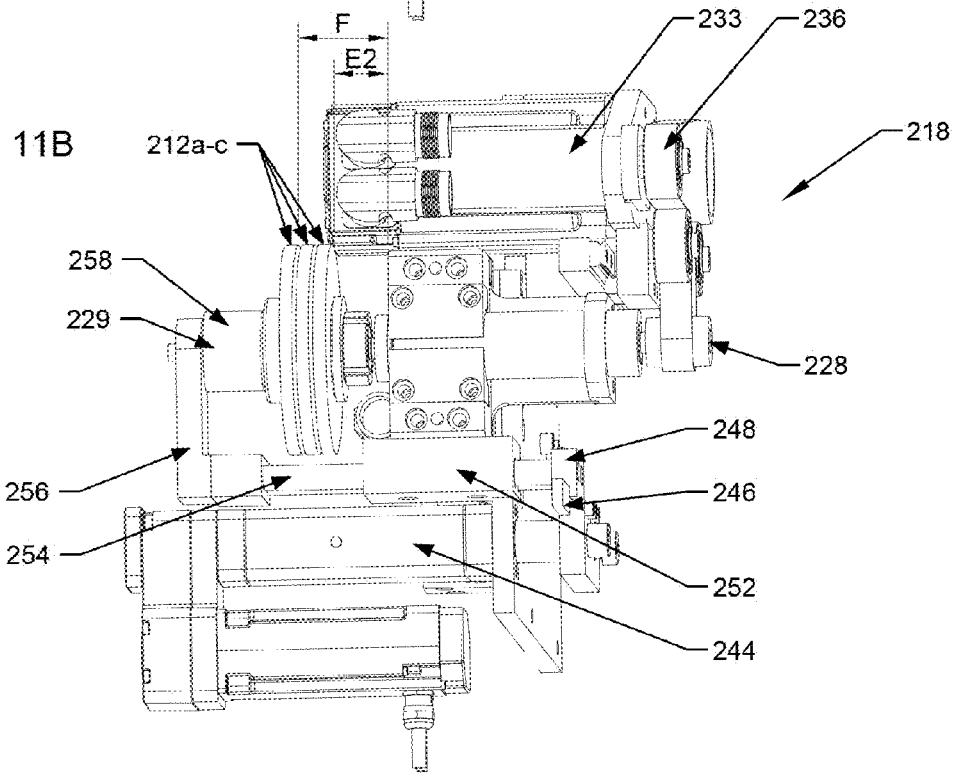
FIG. 11B is a perspective top view of the transmission assembly when the grinding wheels are in an inner position.

FIGS. 11A and 11B are top views of tool exchange assembly 218 and the movement of the grinding wheels 212 relative to the driving motor 233. FIG. 11A shows the grinding wheels 212 in an outer position while FIG. 11B shows the grinding wheels 212 in an inner position. Precision member 244 is used to control the position of the grinding wheels 212 in the y-direction regardless of the position of the grinding wheels 212 in the z-direction and x-direction by using a guide 246 and a sliding member 248 that is slidable along guide 246. When the spindle 228 is in the upper position (FIG. 10A), the distance D between the top of the guide 246 and sliding member 248 changes from D1 to D2 wherein distance D2 is greater than distance D1 while the sliding member 248 holds the grinding wheels 212 in the correction position in the y-direction.

A fastener 252 has a rod 254 attached to a holder 256 that is attached to a driving center 258 of wheel 229 at spindle 228. One important feature of the present invention is that it is very easy to change or shift the grinding wheel used for grinding in order to change the profile of the sharpening of the skate blade. Each grinding wheel 212 has a different profile. Precision member 244 pulls in or pushes out fastener 252, together with rod 254 and holder 256, via guide 246 and slide member 248 in order to move the grinding wheels 212 in the y-direction.

The rotation of spindle 228 is transferred to the grinding wheels 212 by a self-centered axle 260 that self-centers during grinding by the grinding wheels while the grinding wheels are movable in the y-direction, as desired. As indicated above, precision member 244 is used to move the grinding wheels in the y-direction by using guide 246 when it is time to change the grinding wheel to be used for grinding. When the grinding wheels 212 are in the outer position, the distance E is distance E1 and when the grinding wheels are in the inner position, the distance E is reduced to distance E2. When the selected grinding wheel, such as grinding wheel 212*c* in FIG. 4A, is in position F it is properly lined up with the blade 214 in order to sharpen the blade. Precision member 244 pulls in or pushes out, fastener 252, rod 254 to move the whole assembly of the holder 256, driving center 258 and grinding wheels 212 so that the grinding wheels 212 slide on spindle 228 relative to motor 233 until the selected grinding wheel in position F.

In operation, the user simply places the blade 214 of skate 202 and fastens it to the holder 204 and clamp mechanism 206. The apparatus 200 is preferably activated by, for example, a switch so that an automatic self-centered clamping mechanism 206 can clamp the blade 214 and hold it firmly in place. Because the clamping mechanism 206 is automatic and self-centered relative to the position of the selected grinding wheel 212, it automatically adjusts itself to the width of blade 214. By turning on the apparatus 200, the selected grinding wheel 212 starts rotating and the motor 208 starts moving the grinding mechanism in the x-direction towards the blade 214. The desired profile of the blade 214 has been pre-programmed into apparatus 200. The tool exchanger 218 selects the desired grinding wheel 212 by moving the grinding wheels in the y-direction until the desired grinding wheel such as grinding wheel 212*c* is in position F, as described in FIGS. 11A-11B. As the grinding wheel 212*c* encounters blade 214 and moves back and forth in the x-direction, the motor 210 moves the grinding wheel 212*c* in the z-direction according to the pre-programmed instructions to create the desired profile of the blade 214. The movement in the z-direction is a very high precision operation and the fact that spring 222 acts as a counter-balance so that the weight of the grinding components is close to zero enables the motor 210 to move the grinding wheels in the z-direction with little effort that in turn improves the accuracy. The fact that it is not necessary for motor 210 to also lift motor 233 aids the accuracy. As indicated above, thanks to the automatic adjustment of the belt tension of belt 236 regardless of where the grinding wheels are positioned in the z-direction makes it possible to keep the motor 233 and spindle 232 in a stationary position in the z-direction. When the sharpening of blade 214 is complete the user simply releases the blade 214 and skate 202 from holder 204. The skate is sharpened and ready to be used for skating on ice.

While the present invention has been described in accordance with preferred compositions and embodiments, it is to be understood that certain substitutions and alterations may be made thereto without departing from the spirit and scope of the following claims.

I claim:

1. A method for sharpening a blade, comprising:

providing an automatic sharpening apparatus having a holder;

placing a blade into the holder;

a grinding-wheel driving motor, in operative engagement with a wheel on a spindle, rotating a grinding wheel via a belt, a grinding assembly motor moving the grinding wheel in an x-direction towards the blade;

a linear motor moving the grinding wheel from a first position to a second position in a z-direction;

the rotating grinding wheel engaging the blade and the grinding wheel sharpening the blade; and providing a magnetic spring in operative engagement with the linear motor, the spring providing a counter-weight to a weight of a set of grinding wheels, transmission assembly and a tool exchanger assembly.

2. The method according to claim 1 wherein the method further comprises the step of rollers are moved to maintain a constant belt tension of the belt.

3. The method according to claim 1 wherein the method further comprises the step of a precision member moving the set of grinding wheels in a y-direction.

4. The method according to claim 1 wherein the method further comprises the step of the grinding assembly motor moving the set of grinding wheels in the x-direction.

5. The method according to claim 4 wherein the method further comprises the step of maintaining the grinding-wheel driving motor in a stationary position while moving the set of grinding wheels in the x-direction, the y-direction and the z-direction.

* * * * *